United States Patent [19]

Yanagawa et al.

[11] 4,413,600

[45] Nov. 8, 1983

[54] DISTRIBUTOR TYPE FUEL INJECTION PUMP ADAPTED FOR PARTIAL CYLINDER OPERATION OF AN INTERNAL COMBUSTION ENGINE

[75] Inventors: Hajime Yanagawa; Yoshio Suzuki, both of Higashi-Matsuyama, Japan

[73] Assignee: Diesel Kiki Co., Ltd., Tokyo, Japan

[21] Appl. No.: 367,682

[22] Filed: Apr. 12, 1982

[30] Foreign Application Priority Data

Apr. 18, 1981 [JP] Japan ..... 56-55934[U]

[51] Int. Cl.[3] ..... F02M 59/24; F02D 13/06

[52] U.S. Cl. ..... 123/449; 123/503; 123/198 F; 417/494; 417/294

[58] Field of Search ..... 123/449, 503, 198 F, 123/450; 417/492, 494, 499, 500, 289, 294, 282

[56] References Cited

U.S. PATENT DOCUMENTS

| | | | |
|---|---|---|---|
| 2,765,741 | 10/1956 | Hoggman | 417/294 |
| 3,758,241 | 9/1973 | Eheim | 123/503 |
| 3,942,914 | 3/1976 | Hofer | 417/494 |
| 3,945,360 | 3/1976 | Laufer | 123/503 |
| 4,220,128 | 9/1980 | Kobayashi | 123/449 |
| 4,284,047 | 8/1981 | Stumpp | 417/289 |
| 4,362,141 | 12/1982 | Mowbray | 123/449 |

FOREIGN PATENT DOCUMENTS

| | | | |
|---|---|---|---|
| 54-132022 | 10/1979 | Japan | 123/449 |

*Primary Examiner*—Charles J. Myhre
*Assistant Examiner*—Carl Stuart Miller
*Attorney, Agent, or Firm*—Frishauf, Holtz, Goodman & Woodward

[57] ABSTRACT

In a distributor type fuel injection pump of the type including a plunger arranged for reciprocating and rotative motion, and a fuel injection quantity setting member slidably fitted on the plunger and engageable with a cut-off port formed in the plunger and communicating with a pump working chamber, a second cut-off port is formed in the plunger in communication with the pump working chamber, which opens in an outer peripheral portion of the plunger with which the fuel injection quantity setting member permanently slidably engages, and a plurality of spill ports formed in the setting member in a circumferentially spaced relation, which are smaller in number than the cylinders of an engine for use with the pump. When the plunger moves through each delivery stroke in a low engine load region, the second cut-off port engages each one of the spill ports successively to cause injection of fuel into only part of the engine cylinders.

5 Claims, 6 Drawing Figures

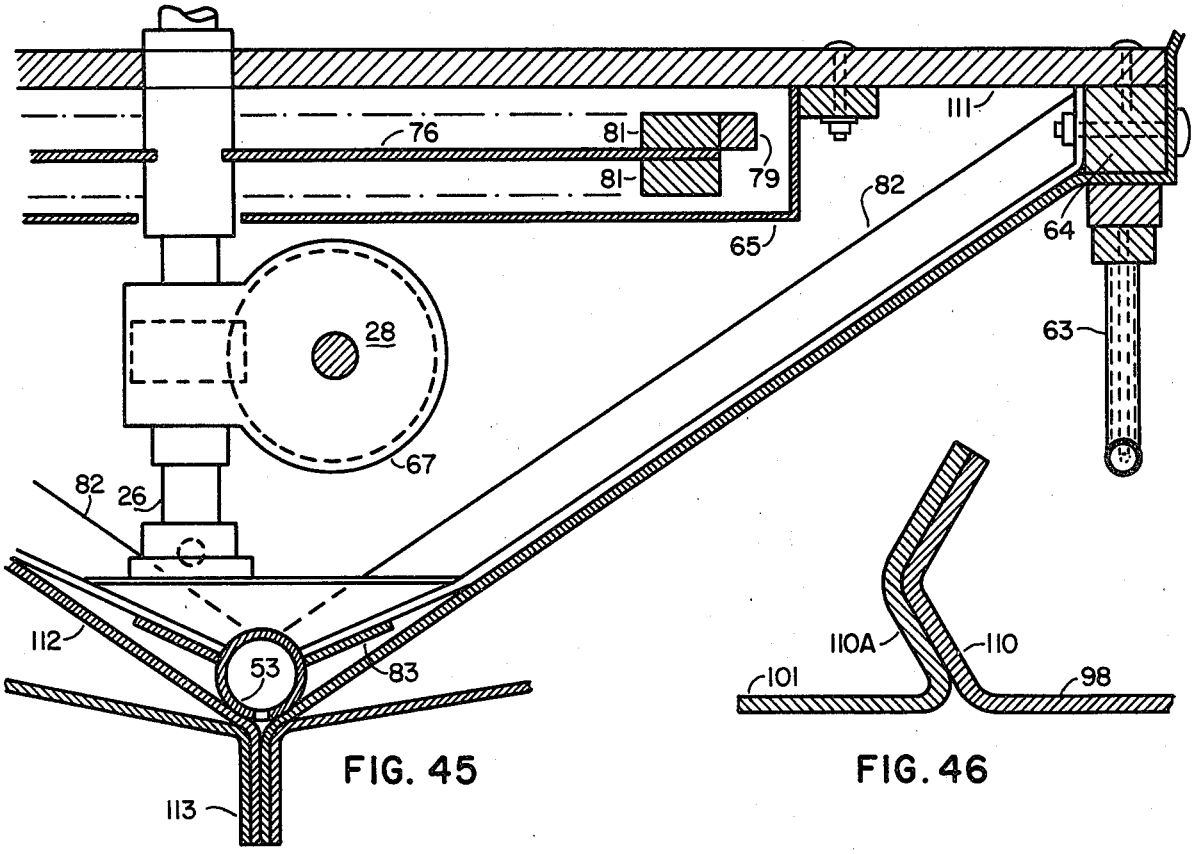
FIG. 45
FIG. 46
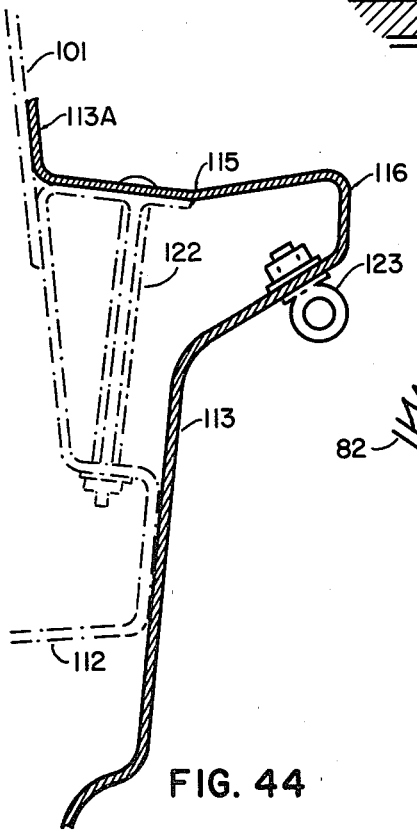
FIG. 44
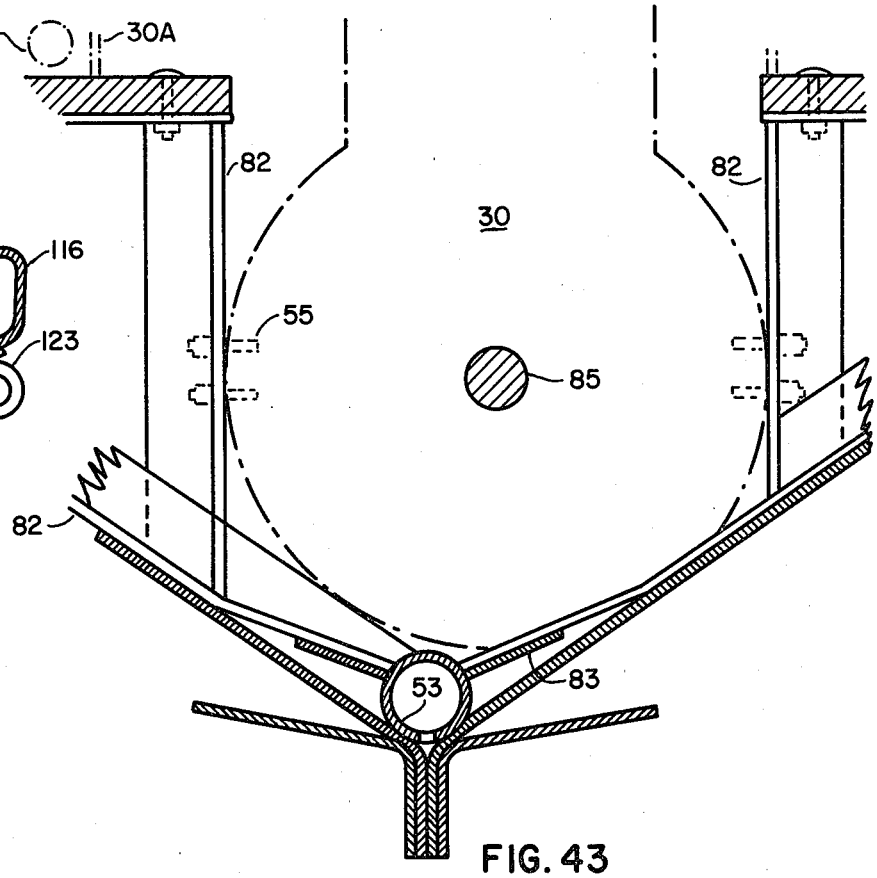
FIG. 43

DISTRIBUTOR TYPE FUEL INJECTION PUMP ADAPTED FOR PARTIAL CYLINDER OPERATION OF AN INTERNAL COMBUSTION ENGINE

BACKGROUND OF THE INVENTION

This invention relates to a distributor type fuel injection pump for use with a fuel-injection engine, and more particularly to a fuel injection pump of this type which is adapted for partial cylinder operation of the engine.

In recent years, to cope with increased fuel cost, it has been proposed and actually practiced to carry out a partial cylinder operation of a diesel engine where fuel is injected into only part of the cylinders of the engine, during low load operation of the engine such as running on a downward slope. For example, to carry out such partial cylinder operation, an in-line type fuel injection pump is provided with a solenoid valve arranged to close one of fuel feeding lines leading to a plurality of plunger pumps of the injection pump to thereby interrupt feeding of fuel to part of the plunger pumps. However, this arrangement cannot be directly applied to a distributor type fuel injection pump which is adapted to feed fuel to all of a plurality of cylinders of an engine through a single plunger pump, as distinct from an in-line type fuel injection pump which is adapted to feed fuel to the engine cylinders through as many respective plunger pumps.

However, while distributor type fuel injection pumps have been widely used in small-sized and medium-sized automotive vehicles, there is an increasing request for saving of the fuel cost for automobile engines. Therefore, strongly desired is the appearance of a distributor type fuel injection pump which enables carrying out a partial cylinder operation of an engine associated therewith.

OBJECTS AND SUMMARY OF THE INVENTION

It is an object of the invention to provide a distributor type fuel injection pump which is arranged to stop pressure feeding fuel to part of the cylinders of an engine associated with the pump, during low load operation of the engine such as idling, thus making it possible to carry out a partial cylinder operation of the engine.

It is another object of the invention to provide a distributor type fuel injection pump which is provided with a partial cylinder operating means which has a simple structure.

According to the present invention, a plunger which is received in a plunger housing for simultaneous reciprocating and rotative motion is formed with a second cut-off port provided in addition to a usual cut-off port. The second cut-off port communicates with a pump working chamber and opens in a portion of the outer peripheral surface of the plunger which is in permanent slidable engagement with a fuel injection quantity setting member (control sleeve). Further, a plurality of spill ports are formed in the fuel injection quantity setting member in circumferentially spaced relation, which are smaller in number to the cylinders of an engine associated with the fuel injection pump of the invention. The spill ports each communicate at one end with a low pressure space (suction chamber) and opens at the other end in the inner peripheral surface of the setting member at a predetermined axial location thereof.

The second cut-off port and the spill ports are arranged relative to each other such that each time a distribution port formed in the plunger engages a predetermined one of outlet pressure channels connected to injection nozzles, the second cut-off port engages a corresponding one of the spill ports during each delivery stroke of the plunger in a predetermined low load region of the engine.

The above and other objects, features and advantages of the invention will be more apparent from the ensuing detailed description taken in connection with the accompanying drawings in which:

DETAILED DESCRIPTION

A preferred embodiment of the invention will now be described in detail with reference to the drawings.

Figure 1:
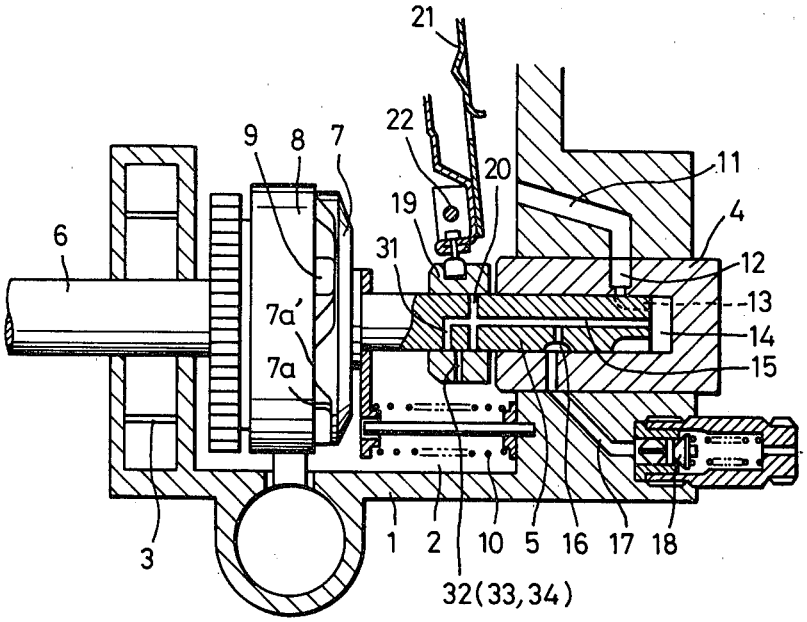
FIG. 1 is a longitudinal sectional view of a distributor type fuel injection pump according to an embodiment of the invention.

Referring first to FIG. 1, a distributor type fuel injection pump according to the invention is illustrated. A pump housing 1 defines therein a suction chamber 2 which is filled with fuel oil supplied under pressure from a feed pump 3 which is secured on a drive shaft 6 arranged to be rotatively driven by an engine, not shown, which is associated with the pump. The fuel pressure within the suction chamber 2 is variable in proportion to changes in the engine speed by means of a pressure regulating valve, not shown, which is connected to the outlet of the feed pump 3.

A plunger barrel 4 is mounted in the pump housing 1, in which is received a plunger 5 which is adapted for simultaneous reciprocating and rotating motion to perform the dual function of fuel pumping and distribution. More specifically, the plunger 5 has its one end provided with a cam plate 7 which is coupled to the drive shaft 6 through a driving disk, not shown, for rotation in unison with the drive shaft 6. Further, the cam plate 7 has a camming surface *7a* formed at circumferentially equal intervals with highs *7a'* corresponding in number to the cylinders of the engine. The cam plate 7 has its camming surface urged against rollers 9 carried on a roller holder 8 by a spring 10 so that rotation of the drive shaft 6 causes the plunger 5 to make a reciprocating motion for fuel pumping and a rotative motion for fuel distribution to injection nozzles, not shown, at the same time.

A pump working chamber 14 is defined by the plunger barrel 4 and the head of the plunger 5, which can communicate with the suction chamber 2 through a fuel supply channel 11 formed in the pump housing, a suction port 12 formed in the plunger barrel 4 and longitudinal grooves 13 formed in the head of the plunger 5. The plunger 5 is formed with a longitudinal channel 15 communicating with the pump working chamber 14 and a distribution port 16 communicating with the channel 15 and opening in the outer peripheral surface of the plunger 5. The distribution port 16 is located for successive engagement with a plurality of outlet pressure channels 17 corresponding in number to the engine cylinders and extending through the plunger barrel 4 and the pump housing 2. These channels 17 open in the inner peripheral surface of the plunger barrel 4 at circumferentially equal intervals. These outlet pressure channels 17 lead to respective delivery valves 18 (only one of them is shown), which are connected to the respective injection nozzles.

A control sleeve 19 as a fuel injection quantity setting member is slidably fitted on a portion of the plunger 5 projecting into the suction chamber 2. On the other hand, a cut-off port 20 is radially formed in the plunger 5 in communication with the longitudinal channel 15 and opens in the outer peripheral surface of the plunger 5. The cut-off port 20 is disposed to be opened and closed by the control sleeve 19 as the plunger 5 is reciprocally moved.

The control sleeve 19 engages a lever 21 which is arranged for povoting about a support 22 by means of an operating input transmission mechanism, not shown, for presetting a desired engine rpm and a governor mechanism, not shown, for governing action in response to actual engine rpm, in such a manner that the angular position of the lever 21 determines the position of the control sleeve 19 on the plunger 5, which in turn determines the fuel injection quantity as hereinlater described.

Figure 2:
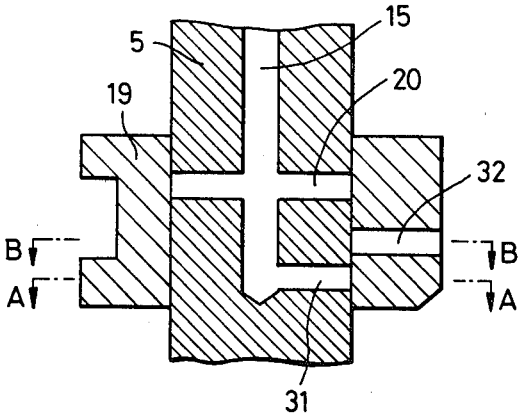
FIG. 2 is a sectional view, on an enlarged scale, of an essential part of the pump of FIG. 1.
Figure 3:
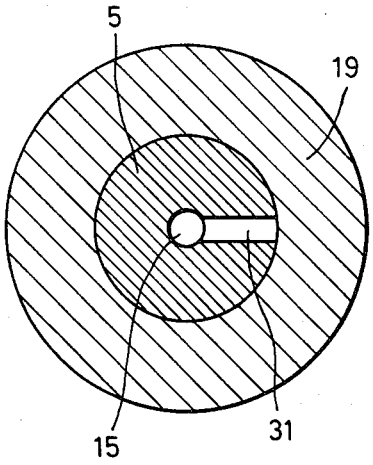
FIG. 3 is a sectional view taken along line A—A in FIG. 2.
Figure 4:
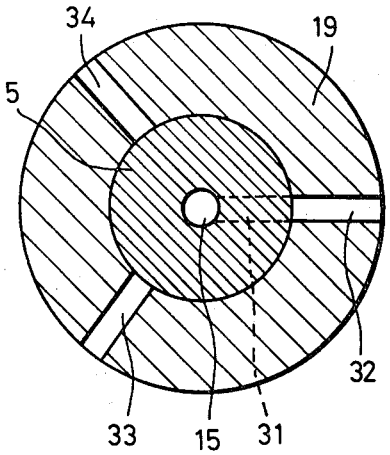
FIG. 4 is a sectional view taken along line B—B in FIG. 2.

As clearly shown in FIGS. 2 and 3, the plunger 5 is further formed with a second cut-off port 31 communicating with the longitudinal channel 15. This port 31 radially opens in an outer peripheral surface portion of the plunger 5 which is permanently engaged or covered with the control sleeve 19 at a location remote from the head of the plunger 5 with respect to the cut-off port 20. In the illustrated embodiment, the second cut-off port 31 opens in the outer peripheral surface of the plunger 5 at a location circumferentially corresponding to that of the distribution port 16. On the other hand, the control sleeve 19 is formed with three radial spill ports 32, 33 and 34 arranged at circumferentially equal intervals with a phase difference of 120 degrees (FIG. 4). These spill ports 32, 33 and 34 open in the inner peripheral surface of the control sleeve 19 at a predetermined axial location thereof and are disposed in facing relation with the outer peripheral surface of the plunger 5 at angular positions each circumferentially corresponding, respectively, to the ascending slope of every other high 7*a* of the cam plate 7, that is, the end of every other outlet pressure channel 17 opening in the inner peripheral surface of the plunger barrel 4.

The operation of the arrangement of the invention described above will now be explained. When the plunger 5 is moved through its suction stroke (in the leftward direction as viewed in FIG. 1), fuel in the suction chamber 2 is supplied into the pump working chamber 14 through the fuel supply channel 11, the suction port 12 and one of the longitudinal grooves 13 in the plunger head. Then, when the plunger 5 begins its delivery stroke (in the rightward direction), the above one longitudinal groove 13 becomes separated from the suction port 12 so that fuel in the pump working chamber 14 is compressed to be fed under pressure through the longitudinal channel 15 and the distribution port 16 in the plunger 5 into one of the outlet pressure channels 17 and then delivered through one of the delivery valves 18 to one of the injection nozzles to be injected into an engine cylinder.

When the cut-off port 20 in the moving plunger 5 becomes disengaged from the right edge (as viewed in FIG. 1) of the control sleeve 19 to open into the suction chamber 2 during the delivery stroke of the plunger 5, the fuel in the pump working chamber 14 flows through the cut-off port 19 into the suction chamber 2, interrupting the fuel delivery into the outlet pressure channels 17 to terminate the fuel injection which has been effected by the above delivery stroke of the plunger 5. The above-described suction and delivery strokes are repeatedly carried out several times corresponding to the number of the engine cylinders, that is, six times in the illustrated embodiment, for each rotation of the plunger 5 through 360 degrees.

Figure 5:
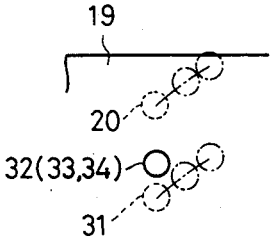
FIG. 5 is a schematic view showing the positional relationship between a spill port formed in the control sleeve and a second cut-off port formed in the plunger at full load operation of the pump according to the invention.
Figure 6:
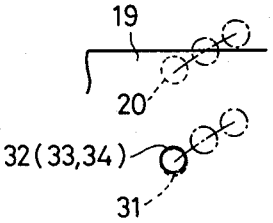
FIG. 6 is a similar view to FIG. 5, showing the same relationship at idling operation of the pump according to the invention.

Now, if the control sleeve 19 is set to a full load position (a rightmost position as viewed in FIG. 1), during a delivery stroke of the plunger 5 which is caused by engagement of a roller 9 with every other high 7*a* of the cam plate 7, a corresponding spill port 32, 33 or 34 is always located out of the orbital path of movement of the second cut-off port 31 throughout the same delivery stroke of the plunger 5, as shown in FIG. 5. Thus, at the full load position, usual pressure feeding of fuel to all the engine cylinders takes place, where the fuel in the pump working chamber 14 is fed under pressure through the longitudinal channel 15, the distribution port 16 and all of the outlet pressure channels 17. On the other hand, if the control sleeve 19 is set to an idling position (in a leftmost position in FIG. 1), during a delivery stroke of the plunger 5 which is caused by engagement of a roller 9 with every other high 7*a'*, a corresponding spill port 32, 33 or 34 is located on the orbital path of movement of the second cut-off port 31, as shown in FIG. 6, so that the former port communicates with the latter port each time the distribution port 16 encounters every other outlet pressure channel 17, allowing the fuel in the pump working chamber 14 to escape into the suction chamber 2 through the engaging ports 31 and 32, 33 or 34. When the plunger 5 then further axially advances during this delivery stroke, the cut-off port 20 becomes disengaged from the control sleeve 19 to open into the suction chamber 2. Thus, during this delivery stroke with the control sleeve 19 at its idling position, no fuel injection takes place at all. In this manner, at engine idle, the pressurized fuel in the pump working chamber 14 is delivered through every other outlet pressure channel 17 so that only half of the engine cylinders which each correspond to the channel 17 are supplied with injected fuel.

Although in the foregoing embodiment the invention is applied to a six cylinder engine where no fuel injection takes place at half of the engine cylinders at engine idle, the invention is of course applicable to an engine having a different number of cylinders, for instance, a four cylinder engine. In the latter case, two spill ports corresponding to those 32, 33 and 32 may be formed in the control sleeve 19 with a phase difference of 180 degrees. Further, the invention is not limited to an arrangement for rendering inoperative half of the engine cylinders, but the number of engine cylinders to be rendered inoperative can be optionally selected by providing a corresponding number of spill ports to such cylinders in the control sleeve 19.

It is to be understood that the foregoing description relates to a preferred embodiment of the invention and that various changes and modifications may be made in the invention without departing from the spirit and scope thereof.

What is claimed is:

1. In a distributor type fuel injection pump for combination with an internal combustion engine having a plurality of cylinders, said pump including: a plunger having an outer peripheral surface; a plunger housing having an inner peripheral surface along which said plunger is received therein and defining therein a pump working chamber in cooperation with a head portion of said plunger; means for causing simultaneous reciprocating and rotative motion of said plunger; a low pressure space in which a portion of said plunger is located; a first port formed in said plunger in communication with said pump working chamber and opening in a portion of said outer peripheral surface of said plunger located in said low pressure space; a second port formed in said plunger in communication with said pump working chamber and opening in another portion of said outer peripheral surface of said plunger located within said plunger housing; a plurality of outlet pressure channels corresponding in number to said cylinders of said engine and connected to respective injection nozzles, said second port being disposed for successive engagement with said outlet pressure channels during said simultaneous reciprocating and rotary motion of said plunger; and a fuel injection quantity setting member having an inner peripheral surface slidably fitted on said portion of said outer peripheral surface of said plunger located in said low pressure space for engagement with said first port, and controllable in axial position relative to said plunger; whereby pressure feeding of fuel caused by movement of said plunger through a delivery stroke thereof is terminated upon disengagement of said first port from said fuel injection quantity setting member; the improvement comprising: a third port formed in said plunger in communication with said pump working chamber, said third port opening in a portion of said outer peripheral surface of said plunger which is in permanent slidable engagement with said fuel injection quantity setting member; and a plurality of fourth ports formed in said fuel injection quantity setting member in circumferentially spaced relation and smaller in number to said outlet pressure channels, said fourth ports each communicating at one end with said low pressure space and opening at the other end in said inner peripheral surface of said fuel injection quantity setting member at a predetermined axial location thereof; wherein said third port and said fourth ports are arranged relative to each other such that each time said second port engages a predetermined one of said outlet pressure channels, said third port engages a corresponding one of said fourth ports, during each delivery stroke of said plunger in a predetermined low load region of said engine.

2. The distributor type fuel injection pump as claimed in claim 1, wherein said engine includes an even number of cylinders, and said outlet pressure channels open in said inner peripheral surface of said plunger housing at circumferentially equal intervals, said fourth ports being half in number of the number of said outlet pressure channels and opening in said inner peripheral surface of said fuel injection quantity setting member at circumferentially equal intervals, said third port and said fourth ports being arranged relative to each other such that each time said second port engages every other one of said outlet pressure channels, said third port engages a corresponding one of said fourth ports, during each delivery stroke of said plunger in said predetermined low load region of said engine.

3. The distributor type fuel injection pump as claimed in claim 1, wherein said predetermined low load region of said engine is an idling region.

4. The distributor type fuel injection pump as claimed in claim 1, wherein said third port opens in said outer peripheral surface of said plunger at a location circumferentially corresponding to that of said second port, said fourth ports each opening in said inner peripheral surface of said fuel injection quantity setting member at a location circumferentially corresponding to that of a corresponding one of said predetermined ones of said outlet pressure channels.

5. The distributor type fuel injection pump as claimed in any one of claims 1 through 4, wherein said fourth ports radially extend in said fuel injection quantity setting member.

* * * * *